US005978759A

United States Patent [19]

Tsushima et al.

[11] Patent Number: 5,978,759

[45] Date of Patent: Nov. 2, 1999

[54] APPARATUS FOR EXPANDING NARROWBAND SPEECH TO WIDEBAND SPEECH BY CODEBOOK CORRESPONDENCE OF LINEAR MAPPING FUNCTIONS

[75] Inventors: Mineo Tsushima, Neyagawa; Yoshihisa Nakatoh, Katano; Takeshi Norimatsu, Kobe, all of Japan

[73] Assignee: Matsushita Electric Industrial Co., Ltd., Osaka, Japan

[21] Appl. No.: 09/157,419

[22] Filed: Sep. 21, 1998

Related U.S. Application Data

[63] Continuation of application No. 08/614,309, Mar. 12, 1996, abandoned.

[30] Foreign Application Priority Data

| | | | |
|---|---|---|---|
| Mar. 13, 1995 | [JP] | Japan | 7-052558 |
| May 9, 1995 | [JP] | Japan | 7-110425 |
| Oct. 5, 1995 | [JP] | Japan | 7-258448 |

[51] Int. Cl.[6] ..... G10L 3/02

[52] U.S. Cl. ..... 704/223; 704/219; 704/500

[58] Field of Search ..... 704/220, 265, 704/500, 222, 203, 200, 219, 221

[56] References Cited

U.S. PATENT DOCUMENTS

| | | | |
|---|---|---|---|
| 4,933,957 | 6/1990 | Bottau et al. | 375/244 |
| 5,293,448 | 3/1994 | Honda | 704/208 |
| 5,455,888 | 10/1995 | Iyengar et al. | 704/203 |
| 5,581,652 | 12/1996 | Abe et al. | 704/222 |

FOREIGN PATENT DOCUMENTS

| | | | |
|---|---|---|---|
| 0 658 874 | 6/1995 | European Pat. Off. | G10L 9/02 |

OTHER PUBLICATIONS

Yuki Yoshida and Masanobu Abe, An Algorithm to Reconstruct Wideband Speech from Narrowband Speech Based on Codebook Mapping, Oct. 9, 1994, pp. 1591–1594, ICSLP 94, Yokohama.

Carl Holger and Ulrich Heute, Bandwidth Enchancement of Narrow–Band Speech Signals, 1994, pp. 1178–1181, Signal Processing VII Theories and Applications Proceedings of EUSIPCO–90 Seventh European Signal Processing Conference.

Lawrence Rabiner and Biing–Hwang Juang, Fundamentals of Speech Recognition, 1993, pp. 72–77, Prentice Hall.

Lawrence R. Rabiner and Ronald W. Schafer, Digital Processing of Speech Signals, 1978, pp. 18–23 and 440–445, Prentice Hall.

Yan Ming Cheng et al., Statistical Recovery of Wideband Speech from Narrowband Speech, Oct. 1994, pp. 544–548, IEEE Transactions on Speech and Audio Processing, vol. 2, No. 4.

*Primary Examiner*—Richemond Dorvil
*Assistant Examiner*—Donald L. Storm
*Attorney, Agent, or Firm*—Wenderoth, Lind & Ponack, L.L.P.

[57] ABSTRACT

Apparatus for expanding the bandwidth of speech signals such that a narrowband speech signal is input and digitized, the spectral envelope information and residual information are extracted from the digitized signal by linear predictive coding analysis, the spectral envelope information is expanded into wideband information by a spectral envelope converter, the residual information is expanded into wideband information by a residual converter, the converted spectral envelope information and residual information are combined to produce a wideband speech signal, frequency information not contained in the input signal is extracted from the obtained wideband speech signal by a filter, and the resulting signal is added to the original digitized input signal, and the obtained signal is converted into an analog signal as the output signal of the apparatus. The apparatus comprises a linear mapping function codebook used for converting spectral parameters, and a weights calculator and an adder for weighing and summing function outputs.

9 Claims, 10 Drawing Sheets

APPARATUS FOR EXPANDING NARROWBAND SPEECH TO WIDEBAND SPEECH BY CODEBOOK CORRESPONDENCE OF LINEAR MAPPING FUNCTIONS

This is a rule 1.53(b) Continuation of Application Ser. No. 08/614,309, filed Mar. 12, 1996.

BACKGROUND OF THE INVENTION

1. Field of the Invention

The present invention relates to an apparatus for producing wideband speech signals from narrowband speech signals and, in particular, relates to an apparatus for producing wideband speech from telephone-band speech.

2. Description of the Related Art

Among prior methods of expanding speech bandwidth, there is the method described in Y. Yoshida, T. Abe, et al. "Recovery of wideband speech from narrowband speech by codebook mapping", Denshi Joho Tsushin Gakkai Shingakuho SP 93-61 (1993) (in Japanese language) and the method described in Y. Cheng, D. O'Shaughnessy, P. Mermelstein, "Statistical recovery of wideband speech from narrowband speech", Proceed. ICSLP 92 (1992), pp. 1577–1580.

According to the method by Yoshida et al. a large number of code words, for instance 512 codes, have been necessary for reliably expanding speech bandwidth, since the method relies on codebook mapping. On the other hand, the method of Cheng et al. had a problem in the quality of the synthesized speech, since white noise, which is not correlated to the original speech, is added.

SUMMARY OF THE INVENTION

An object of the present invention is therefore to produce a wideband speech signal from a narrowband speech signal using a small number of codes.

Another object of the present invention is to produce a wideband speech signal from a telephone-band speech signal.

A further object of the present invention is to produce a clear wideband speech signal from a narrowband speech signal.

In order to achieve the aforementioned objects, the present invention obtains a wideband speech signal from a narrowband speech signal by adding thereto a signal of a frequency range outside the bandwidth of the narrowband speech signal. Preferably, the present invention extracts features from the narrowband speech signal to create a synthesized wideband signal which is added to the narrowband speech signal. In a further preferred composition, the present invention separates a narrowband speech signal into a spectrum information signal and a residual information signal to expand the bandwidth of both information signals and to combine them.

By means of the above composition, the present invention expands the bandwidth of a speech signal without altering the information contained in the narrowband speech signal. Further, the present invention can produce a synthesized signal having a great correlation with the narrowband speech signal. Still further, the present invention can freely vary the precision of the system by clarifying the process of expanding the bandwidth.

BRIEF DESCRIPTION OF THE DRAWINGS

These and other objects and features of the present invention will become clear from the following description taken in conjunction with the preferred embodiments thereof with reference to the accompanying drawings throughout in which like parts are designated by like reference numerals, and in which:

FIGS. 9 and 10 illustrate a graph of the number of subspaces and mean distances between the original word speech and the word speech synthesized according to the present invention, in which FIG. 9 shows the results obtained by male speech and FIG. 10 shows those obtained by female speech.

DETAILED DESCRIPTION OF THE PREFERRED EMBODIMENTS

The preferred embodiments according to the present invention will be described below with reference to the attached drawings.

Figure 1:
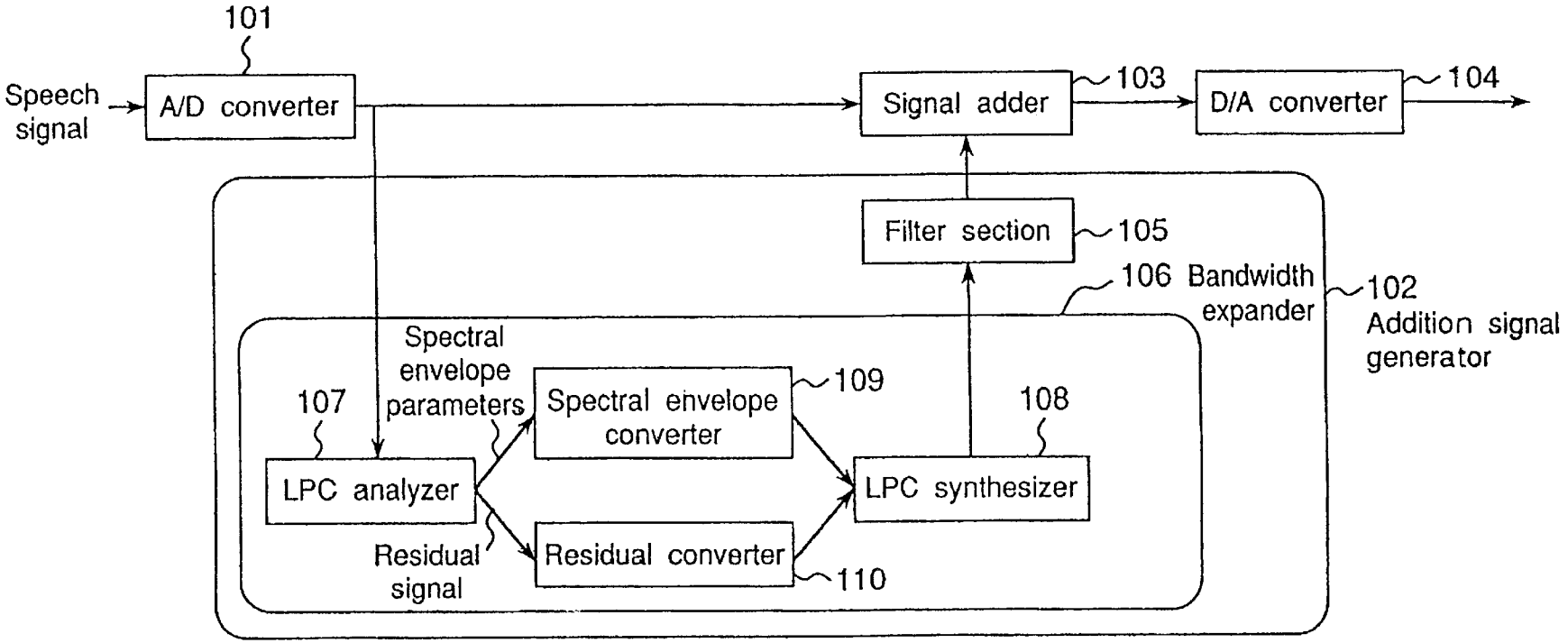
FIG. 1 is a block diagram illustrating the apparatus for expanding the speech bandwidth of an embodiment in accordance with the present invention.

FIG. 1 is a block diagram illustrating the apparatus for expanding the speech bandwidth of an embodiment in accordance with the present invention. In FIG. 1, 101 is an A-D converter that converts an original narrowband speech analog signal input thereto into a digital speech signal. The output of the A-D converter 101 is fed to a signal adder 103 and an addition signal generator 102. The addition signal generator 102 extracts features from the output signal of the A-D converter 101 so as to output a signal having frequency characteristics of a bandwidth which are wider than the bandwidth of the input signal. Signal adder 103 algebraically adds the output of the A-D converter 101 and the output of the addition signal generator 102 and outputs the resulting signal. A D-A converter 104 converts the digital signal outputted from the signal adder 103 into an analog signal which is outputted. The present embodiment generates an output signal of a bandwidth which is wider than that of the original signal by this composition.

Next, the composition of the addition signal generator 102 is described. A bandwidth expander 106 reads the output signal of the A-D converter 101 to generate a signal of a bandwidth which is wider than that of the read signal. It comprises a bandwidth expander 106 and a filter section 105. The output signal of the bandwidth expander 106 is fed to a filter section 105. The filter section 105 extracts frequency components which exist outside the bandwidth of the original signal. For example, if the original signal has frequency components of 300 Hz to 3,400 Hz, then the bandwidth of the components extracted by the filter section 105 is the band below 300 Hz and the band above 3,400 Hz.

However, it is not necessary to extract all components which exist outside the bandwidth of the original signal. The filter section 105 is preferably configured with a digital filter, which may be either an FIR filter or an IIR filter. The FIR and IIR filters are well known and can be realized, for example, by the compositions described in Simon Haykin, "Instruction to adaptive filters", (Macmillan).

Next, the composition and operation of the bandwidth expander 106 are described. In the bandwidth expander 106, an LPC (Linear Predictive Coding) analyzer 107 first reads the output signal of the A-D converter 101 to perform a linear predictive coding (LPC) analysis. The LPC analysis is well known and can be realized, for example, by the methods described in Lawrence R. Rabiner, "Digital processing of speech signals", (Prentice-Hall). These methods are incorporated by reference. The LPC analyzer 107 obtains LPC coefficients, which are also called linear predictive codings. The number P of the LPC coefficients, i.e. dimension P of the feature vector extracted by the LPC analyzer is chosen in relation to the sampling frequency and is selected at ten or sixteen since the sampling frequency is 16 kHz in the speech analysis. The LPC analyzer 107 then obtains other sets of feature amounts from the LPC coefficients by transformations. These feature amounts are reflection coefficients, PARCOR (partial correlation) coefficients, Cepstrum coefficients, LSP (line spectrum pair) coefficients and other, and they are all spectral envelope parameters obtained by the LPC coefficients. Further, the LPC analyzer 107 obtains a residual signal from the LPC coefficients. The residual signal is the difference between the output signal of the A-D converter 101 and the predicted signal output from an FIR filter having filter coefficients given by the LPC coefficients. That is, if the output signal of the A-D converter 101 is denoted by $r(t_n)$ wherein $t_n$ denotes a present sampling time and $t_{n-1}$ (i=1, 2, . . . , p) denotes a sampling time i times before, and the LPC coefficients are denoted by $a_i$, i=1, 2, . . . , p, then the residual signal $r(t_n)$ is $$r(t_n)=y(t_n)-a_1y(t_{n-1})-a_2y(t_{n-2})-\ldots-a_py(t_{n-p}) \quad (1)$$

The spectral envelope parameters outputted from the LPC analyzer 107 are converted, by a spectral envelope converter 109, into spectral envelope parameters of a bandwidth which is wider than the bandwidth of the IIR filter constructed with the spectral envelope parameters outputted from the LPC analyzer 107. On the other hand, the residual signal outputted from the LPC analyzer 107 is converted, by a residual converter 110, into a residual signal of a bandwidth which is wider than that of the residual signal outputted from the LPC analyzer 107. An LPC synthesizer 108 synthesizes a digital speech signal from the output of the spectral envelope converter 109 and the output of the residual converter 110.

The spectral envelope converter 109 converts the input spectral envelope parameters into spectral envelope parameters of a wider bandwidth as follows. Namely, assuming â and fa denote an input feature vector having p elements comprising the input spectral envelope parameters and an output or converted feature vector obtained by a k th linear mapping function of matrix $B_k$=(bij) (i,j=1, . . . , p, k=1, . . . , M M; the number of linear mapping functions), respectively, fa is given by the following equation:

$$\hat{fa} = B_k \cdot \hat{a} \quad (2)$$

$$\left( fai = \sum_{j=1}^{P} {}^{k}_{bij} \cdot aj \right)$$

Figure 2:
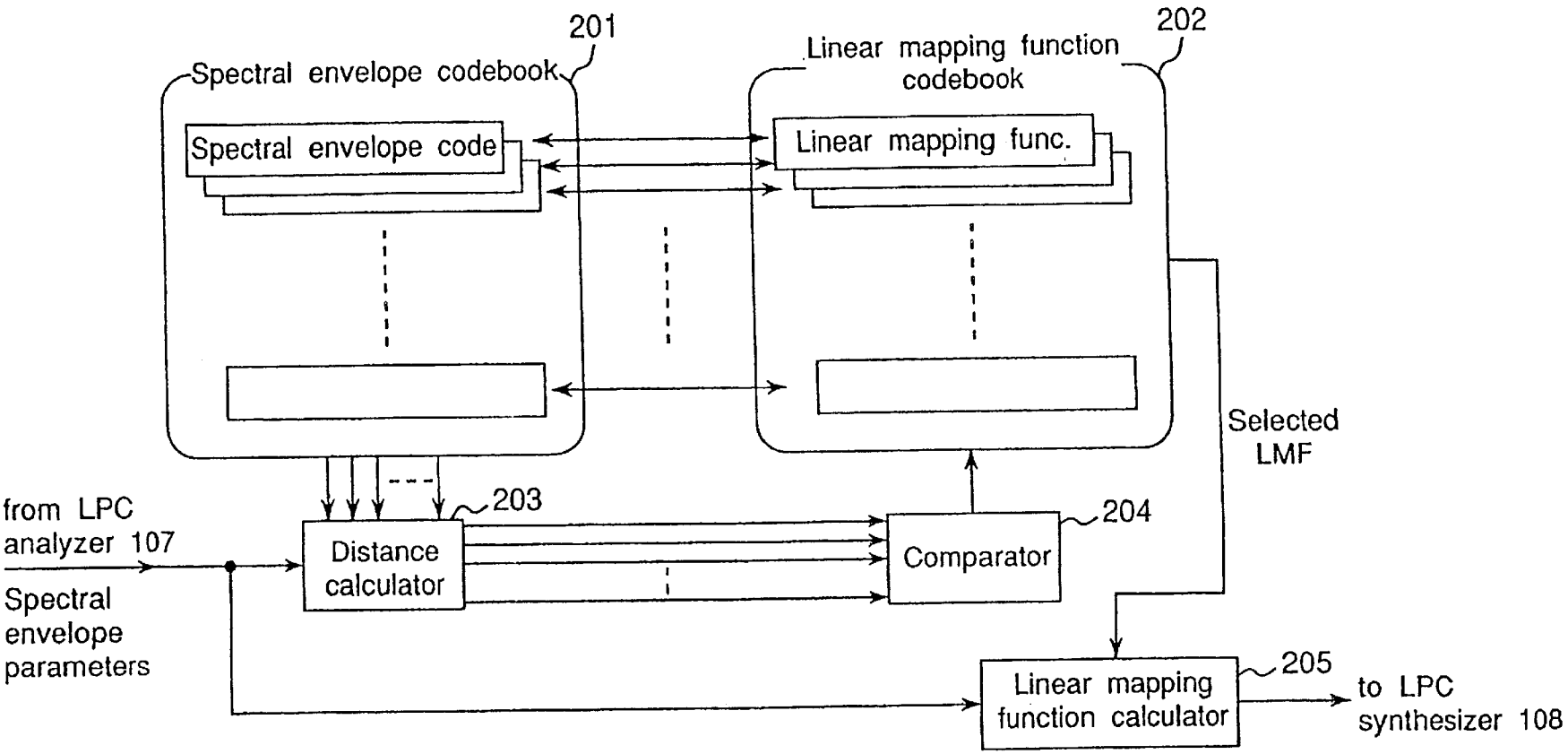
FIG. 2 is a block diagram illustrating the spectral envelope converter shown in FIG. 1.

The spectral envelope converter 109 can also be realized by the composition shown in FIG. 2. In this composition, the spectral envelope converter 109 comprises a spectral envelope codebook 201 that has a M spectral envelope codes, for instance sixteen codes, each of which is representative of a set of spectral envelope parameters, and a linear mapping function codebook 202 that has M linear mapping functions, each of which corresponds to a spectral envelope code of the spectral envelope codebook 201 one to one. The spectral envelope codes are created by dividing a multi-dimensional space of the spectral envelope parameters into M subspaces and by averaging the spectral envelope parameter vectors belonging to each subspace. For example, if the jth feature value of the ith spectral envelope parameter vector belonging to a subspace is $a_{ij}$, then the jth feature value $c_j$ of the spectral envelope code corresponding to that subspace is $$c_j = \sum_{i=1}^{R} a_{ij} / R, \quad (3)$$

where R is the number of spectral envelope parameter vectors (feature vectors) belonging to the subspace.

The spectral envelope parameters obtained by the LPC analyzer 107 are fed to a distance calculator 203, and a linear mapping function calculator 205. The distance calculator 203 calculates the distance between the spectral envelope parameters a(j), j=1, . . . , p outputted from the LPC analyzer 107 and each spectral envelope code stored in spectral envelope codebook 201. If the jth feature value of the ith spectral envelope code is $c_{ij}$, then the distance is obtained by the equation $$d_i = \sum_{j=1}^{P} |a(j) - c_{ij}|^2, \quad (4)$$

where i=1, . . . , M, and M is the number of spectral envelope codes which is equal to the number of the divided subspaces. The calculated results of the distance calculator 203 are inputted to a comparator or selector 204. The comparator 204 selects the minimum distance of the input multiple distances and outputs, into a linear mapping function calculator 205, a linear mapping function stored in the linear transformation codebook 202 and corresponding to the linear spectral code that gives the selected minimum distance. The linear mapping function calculator 205 performs computations similar to equation (2) based on the spectral envelope parameters outputted from the LPC analyzer 107 and the linear transformation outputted from the comparator 204. The output of linear mapping function calculator 205 is the converted spectral envelope parameters in the present composition.

In the following, a learning method for determining spectral envelope codes and corresponding linear mapping functions is explained:

(a) A plurality of word speech samples of a wideband are prepared.

(b) Each of these word speech samples is LPC analyzed to obtain LPC parameters of the wideband.

(c) Each of these word speech samples is transformed to corresponding word speech samples of a narrowband by filtering each original speech using a low frequency cut filter and a high frequency cut filter. Then, each word speech sample of the narrowband is LPC analyzed to obtain LPC parameters of the narrowband.

(d) Next, a multi-dimension space of the feature vectors thus obtained regarding word speech samples of the narrowband is divided into subspaces of an appropriate number. This is done so as to satisfy the following conditions:

<d1> Consider M subspaces and calculate a mean value of feature vectors belonging to one of M subspaces. A central value obtained by mean values of M subspaces is as close as possible to a central value obtained by averaging all feature vectors now considered.

<d2> The number of feature vectors belonging to each subspace is substantially equal to each other. Namely, feature vectors are uniformly distributed over all subspaces.

(e) When the division into M subspaces is achieved, linear mapping functions are sought for M subspaces. Since the relationship between each original word speech and the corresponding narrowband word speech has been obtained, each linear mapping function is determined so that a distance between the original word speech of the wideband and a word speech mapped into the corresponding subspace by that linear mapping function can be minimized.

Figure 9:
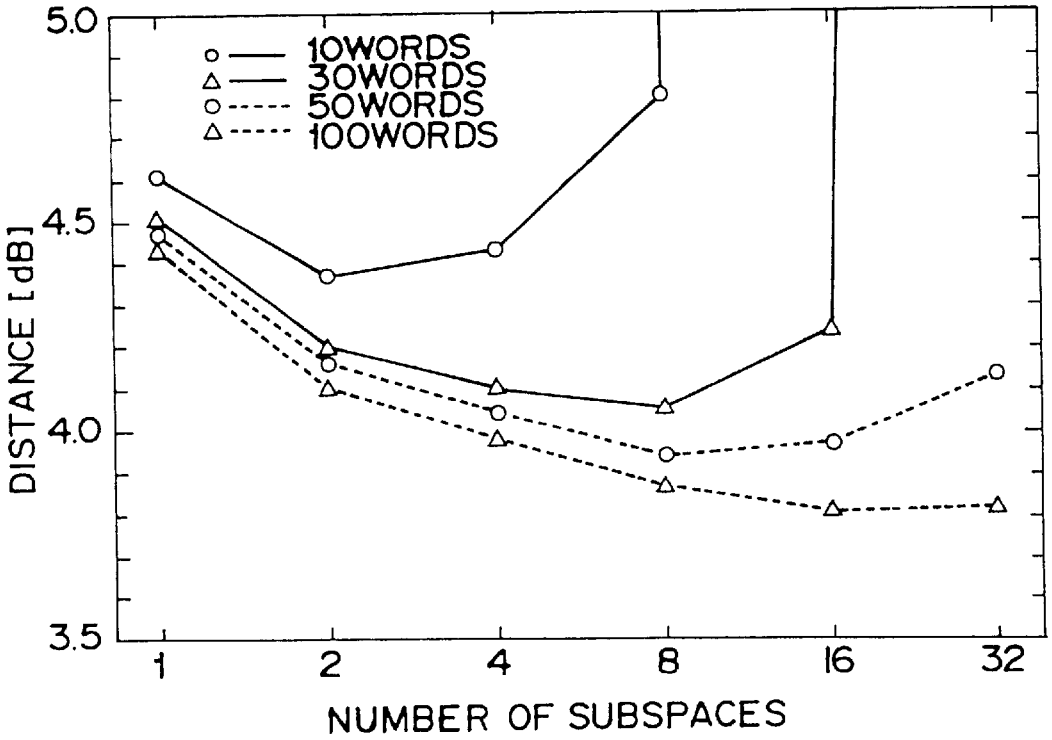
Figure 10:
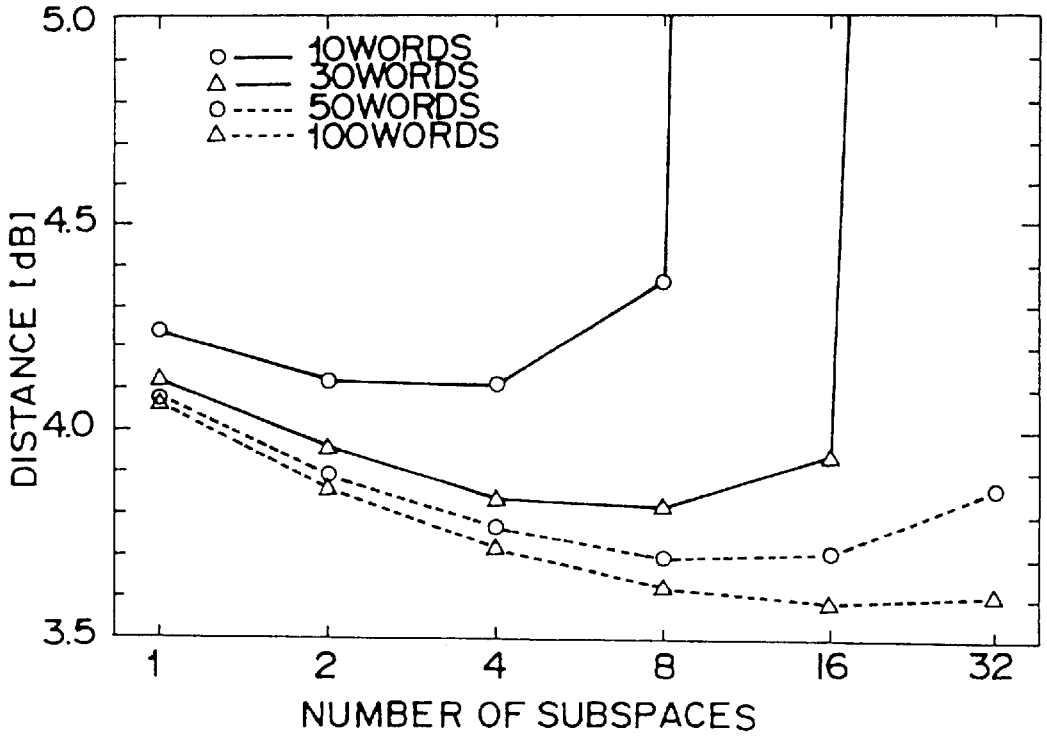

FIGS. 9 and 10 illustrate a graph of the number of subspaces versus the mean distances between the original word speech and the word speech synthesized according to the present invention. FIG. 9 illustrates results obtained for male speech and FIG. 10 illustrates results obtained for female speech.

It is to be noted that the mean distance is minimized at 16 when 100 word speech samples have been used for learning. In other words, enough learning with an enough number of word speech samples does not necessitate more of subspaces than 16. This fact indicates that the method of the present invention can simplify the expansion operation from narrowband to wideband resulting in a quick response.

Figure 3:
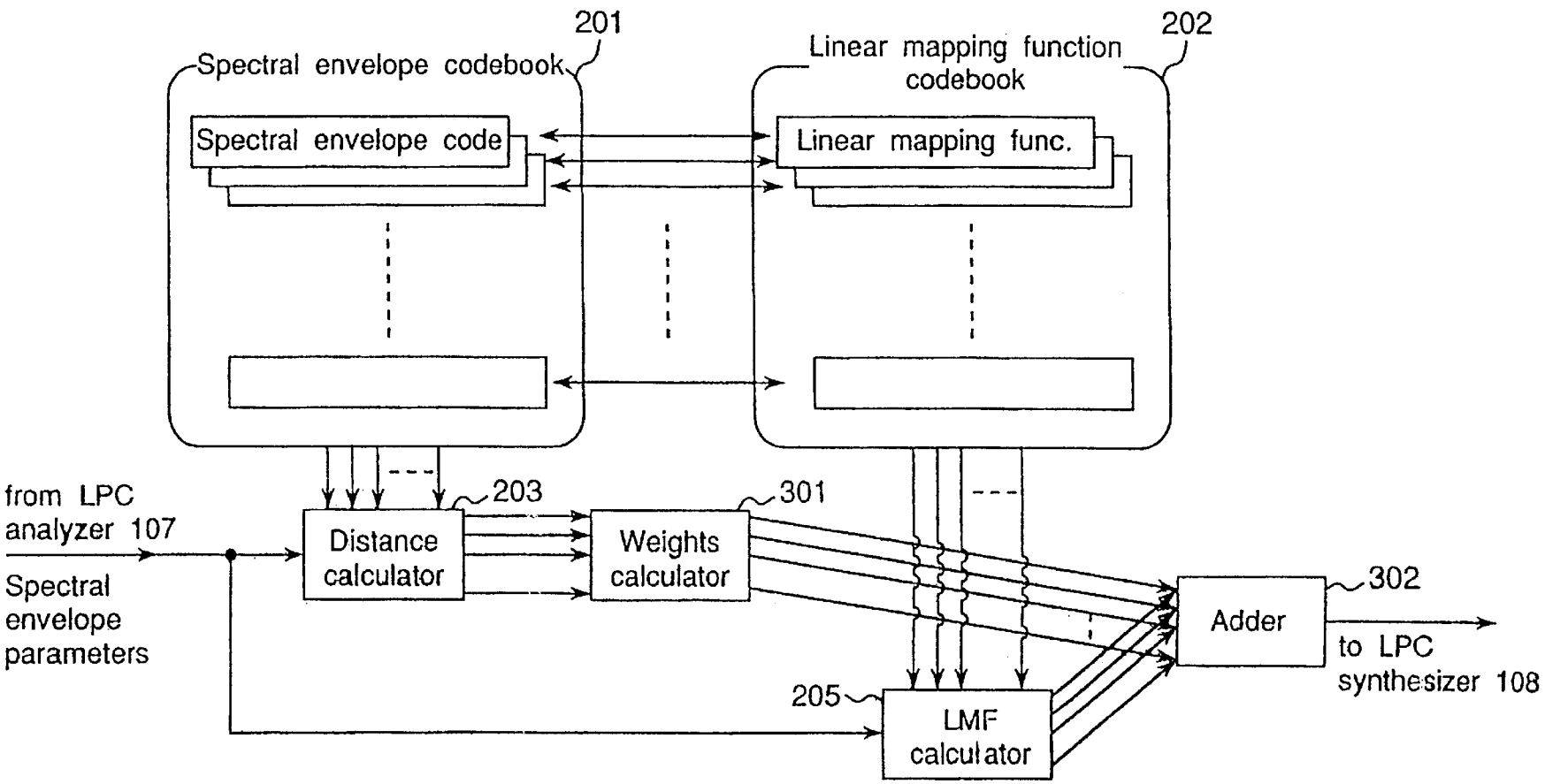
FIG. 3 is a block diagram illustrating another spectral envelope converter of the embodiment in accordance with the present invention.

FIG. 3 shows another composition of spectral envelope converter 109. In the composition of the FIG. 3, the compositions of spectral envelope codebook 201, linear mapping function codebook 202, distance calculator 203, and the linear mapping function calculator 205 are the same as in FIG. 2. The spectral envelope parameters outputted from the LPC analyzer 107 are inputted to a distance calculator 203 and a linear transformation calculator 205. The distance calculator 203 calculates the distance between the spectral envelope parameters outputted from the LPC analyzer 107 and each spectral envelope code stored in the spectral envelope codebook 201. The results are inputted to a weights calculator 301. The weights calculator 301 calculates a weight corresponding to each spectral envelope code by the following equation (5).

$$w_i = d_i \Big/ \sum_{k=1}^{M} d_k, \tag{5}$$

where $w_i$ is the weight corresponding to the ith spectral envelope code, and $d_i$ is the distance to the ith spectral envelope code calculated by the distance calculator 203. On the other hand, the linear mapping function calculator 205 reads the spectral envelope parameters â outputted from the LPC analyzer 107 and each linear mapping function $B_i$ (i=1, . . . , M) stored in the linear mapping function codebook 202 to transform the former into spectral envelope parameters fa by a method similar to equation (2). The output of the weights calculator 301 and the output of the linear mapping function calculator 205 are inputted to a linear transformation results adder 302. The linear transformation results adder 302 calculates the converted spectral envelope parameters wa by the following equation (6):

$$\hat{wa} = \sum_{i=1}^{M} w_i \cdot B_i \hat{a} \tag{6}$$

Figure 4:
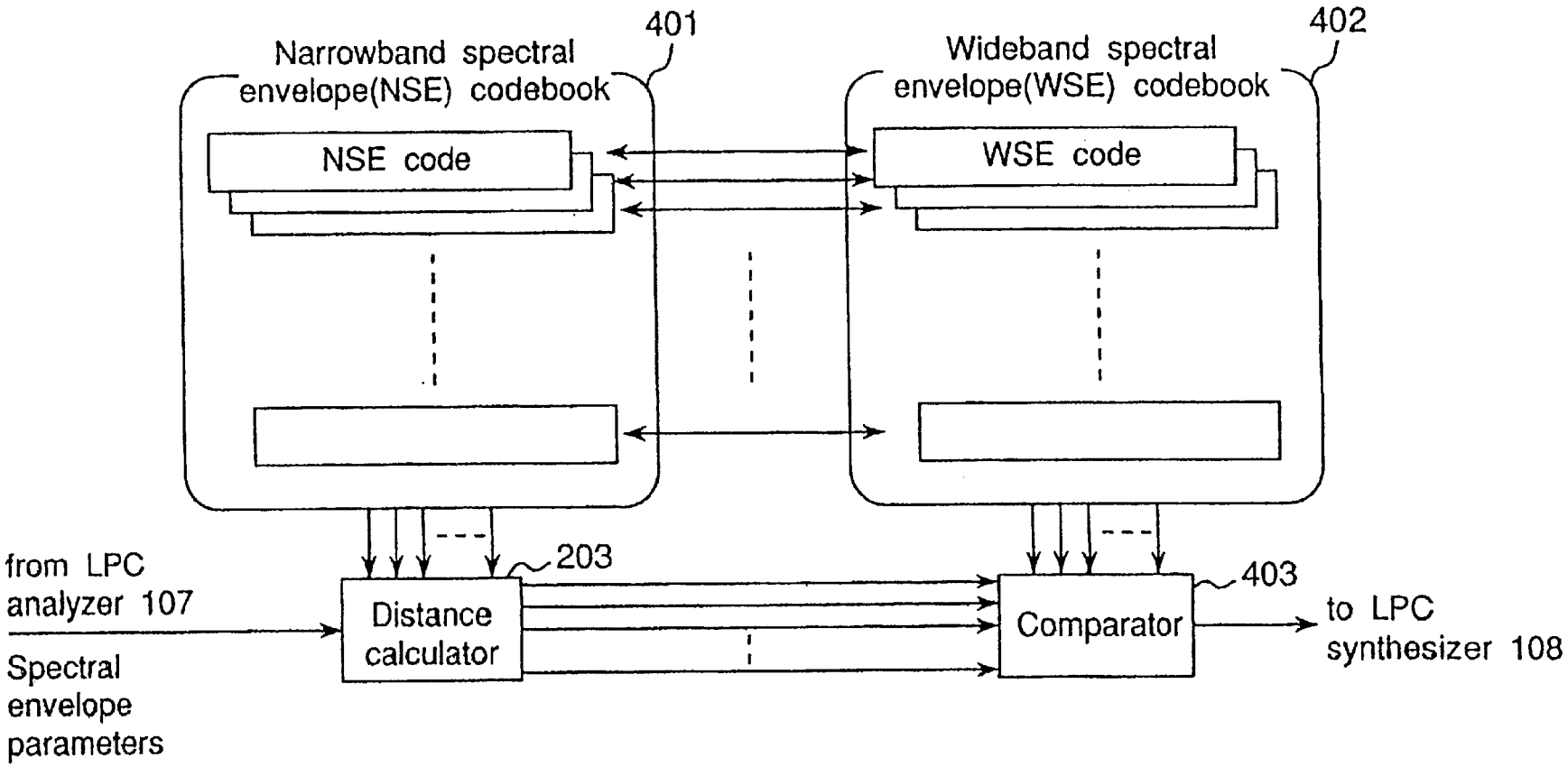
FIG. 4 is a block diagram illustrating another spectral envelope converter of the embodiment in accordance with the present invention.

Another composition of the spectral envelope converter 109 is shown in FIG. 4. In this composition, the spectral envelope converter 109 has a narrowband spectral envelope codebook 401 that has a plurality of spectral envelope codes having narrowband spectral envelope information and a wideband spectral envelope codebook 402 that has spectral envelope codes having wideband spectral envelope information and a one-to-one correspondence with the narrowband spectral codes. The spectral envelope parameters outputted from the LPC analyzer 107 are inputted to the distance calculator 203 of FIG. 2. Using the equation (4), the distance calculator 203 calculates the distance between the spectral envelope parameters outputted from the LPC analyzer 107 and each narrowband spectral envelope code stored in narrowband spectral envelope codebook 401 to output the calculated results to the comparator 403. The distance calculator 203 can use the following equation (7) in place of the equation (4):

$$d_i = \sum_{j=1}^{p} |a(j) - c_{ij}|^x, \tag{7}$$

where x may be a number other than 2. Preferably, x may be between 2 and 1.5. The comparator 403 extracts, from the wideband spectral envelope code book 402, the wideband spectral envelope code corresponding to the narrowband spectral envelope code that gives the minimum value of the distances calculated by distance calculator 203. The extracted wideband spectral envelope code is made to be the converted spectral envelope parameters in the present composition.

Figure 5:
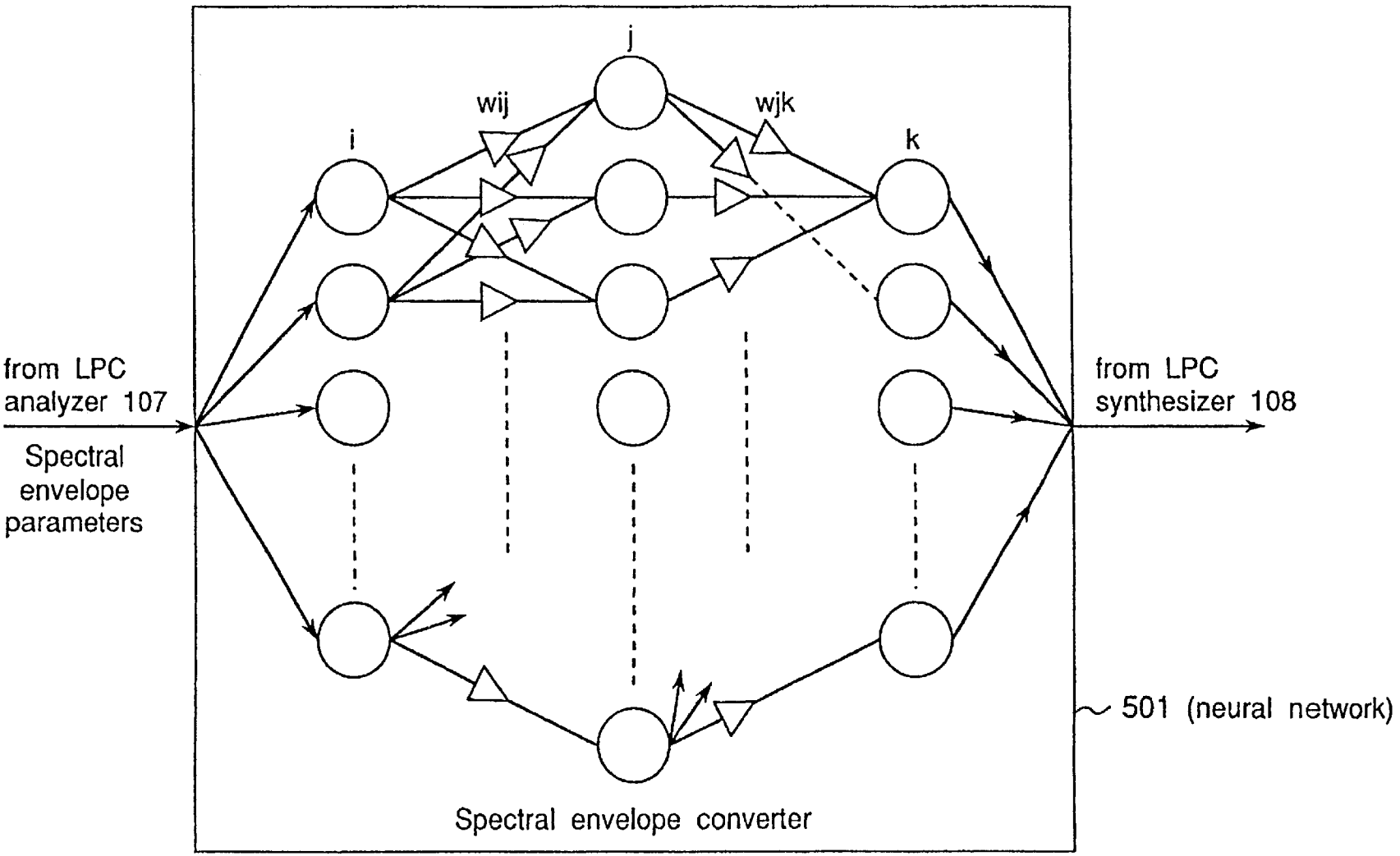
FIG. 5 is a block diagram illustrating another spectral envelope converter of the embodiment in accordance with the present invention.

Another composition of the spectral envelope converter 109 is described in FIG. 5. In this composition, a neural network is used to convert the spectral envelope parameters. Neural networks are well-known techniques, and can be realized, for example, by the methods described in E. D. Lipmann, "Introduction to computing with neural nets", IEEE ASSP Magazine (1987), pp. 4–22. An example is shown in FIG. 5. The spectral envelope parameters outputted from the LPC analyzer 107 are inputted to a neural network 501. If the inputted spectral envelope parameters are a(i) i=1, . . . , p, then the converted spectral envelope parameters in the present method, fa(k), are $$fa(k) = \sum_{j} w_{jk} b_j, \tag{8}$$

$$b_j = \sum_{i=1}^{p} w_{ij} a(i), \tag{9}$$

where $w_{ij}$ and $w_{jk}$ are respectively the weights between the ith layer and the jth layer and the weights between the jth layer and the kth layer. Besides the three-layer composition shown in FIG. 5, the neural network may be constructed with a greater number of layers. Further, the equations for calculation may be different from (8) and (9).

Figure 6:
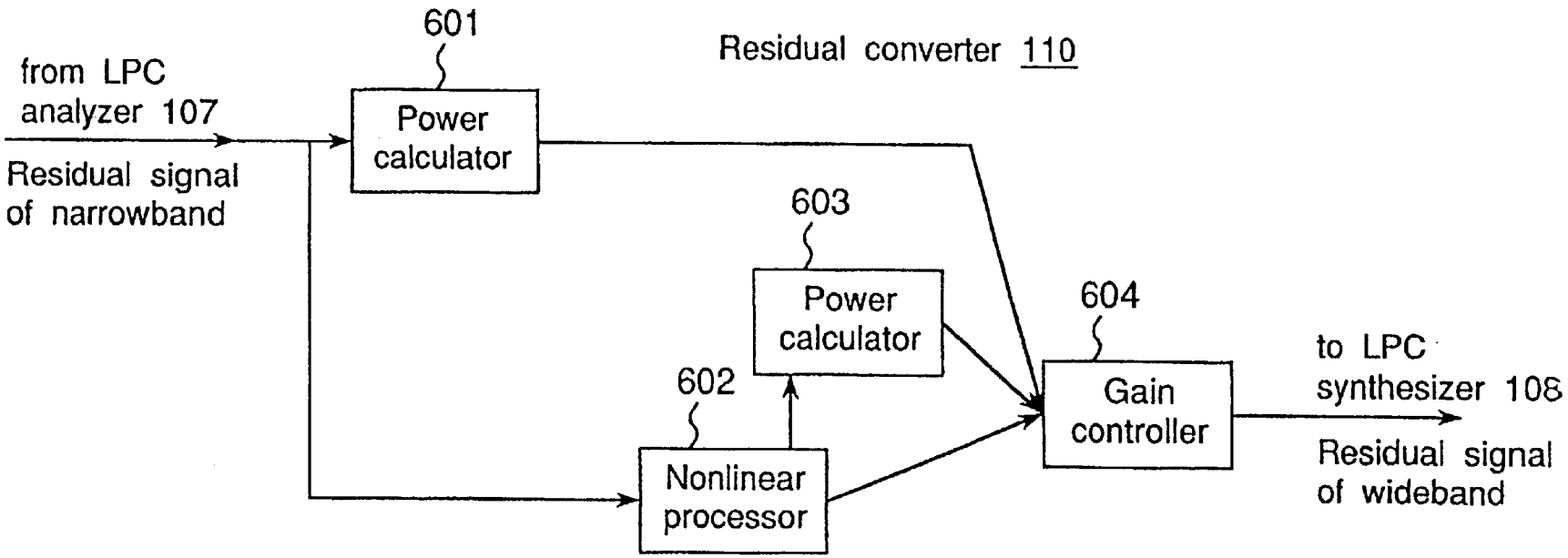
FIG. 6 is a block diagram illustrating the residual converter shown in FIG. 1.

Next, a preferred example of a residual converter 110 is described with reference to FIG. 6. The residual signal outputted from the LPC analyzer 107 is fed to a power calculator 601 and a nonlinear processor 602. The power calculator 601 calculates the power of the residual signal by summing the powers of each value of the residual signal and dividing the result by the sample number. Specifically, the power g is calculated by $$g = \left(\sum_{i=1}^{p} r(i)^2\right) \Big/ p, \tag{10}$$

where r(i), i=1, . . . , p are the residual signal values. The nonlinear processor 602 performs nonlinear processing of the residual signal to obtain a processed residual signal. The processed residual signal is fed to a power calculator 603 and a gain controller 604. The gain controller 604 multiplies the processed residual signal outputted from the nonlinear processor 602 by the ratio of the power obtained by the power calculator 601 to the power obtained by the power calculator 603. That is, if the residual signal values processed by the nonlinear processor 602 are nr(i), i=1, . . . , p, then the residual signal values fnr(i), i=1, . . . , p outputted from the gain controller 604 are calculated by $$fnr(i)=g_1/g_2 \cdot nr(i), \tag{11}$$

where $g_1$ is the power obtained by the power calculator 601 and $g_2$ is the power obtained by the power calculator 603. These fn(i) are the outputs of the residual converter 110 of the present example.

The nonlinear processor 602 can be realized using full-wave rectification or half-wave rectification. Alternatively, the nonlinear processor 602 can be realized by setting a threshold value and fixing the residual signal values at the threshold value if the magnitude of the original residual signal values exceeds the threshold value. In this case, the threshold value is preferably determined based on the power obtained by the power calculator 601. For example, the threshold value is set at $0.8.g_1$, where $g_1$ is the power outputted from the power calculator 601. Other methods of calculating the threshold value are also possible.

Another composition of the nonlinear processor 602 can be realized using the multi-pulse method. The multi-pulse method is well known and described, for example, in B. S. Atal et al., "A new model of LPC excitation for producing natural sound speech at very low bit rates", Proceed. ICASSP (1982), pp. 614–617. In this composition, the nonlinear processor 602 generates multi-pulses to perform nonlinear processing of the residual signal obtained by the LPC analyzer 107.

Figure 7:
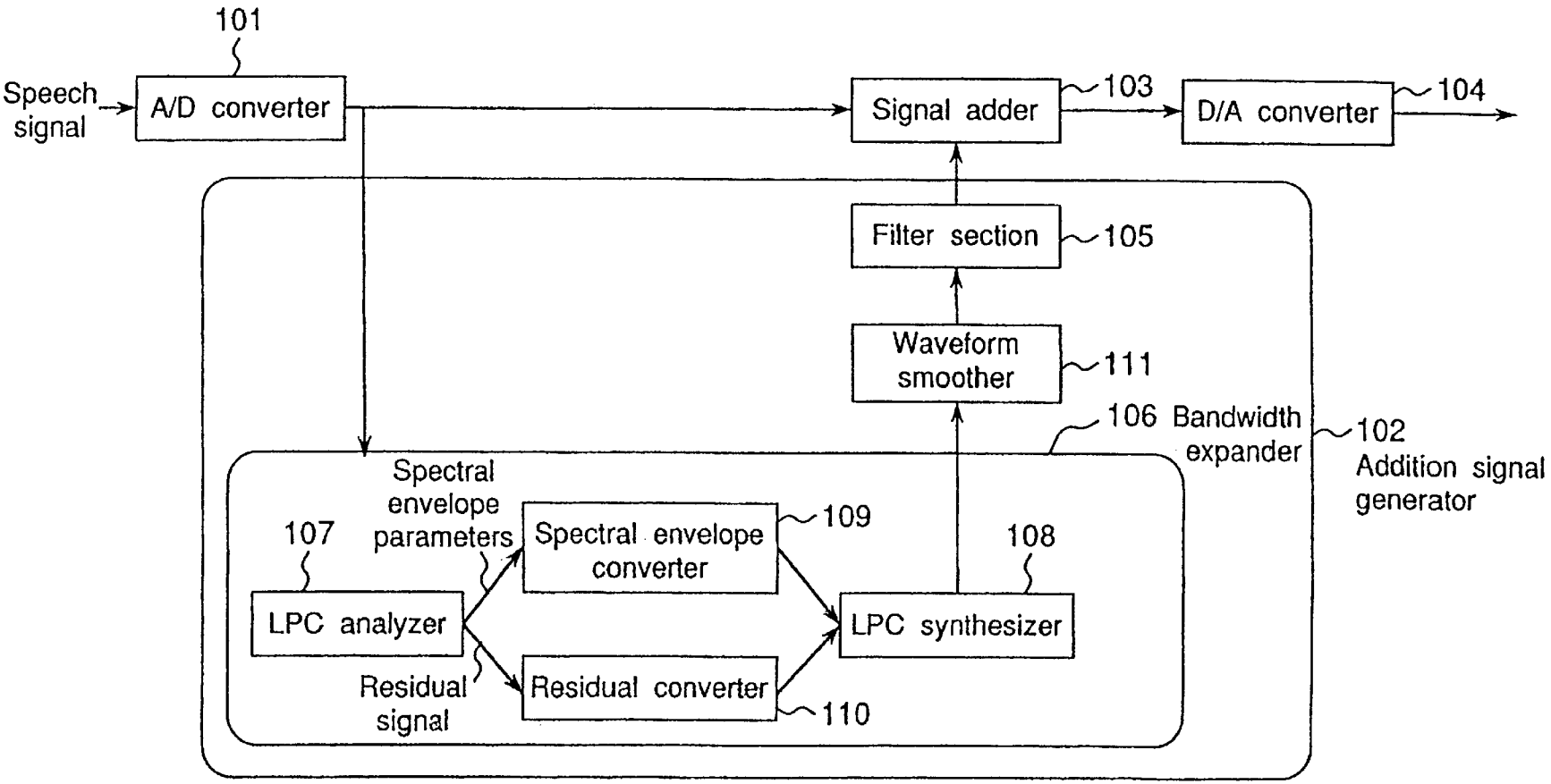
FIG. 7 is a block diagram illustrating the apparatus for expanding the speech bandwidth of another embodiment in accordance with the present invention.

In the following is described a second embodiment in accordance with the present invention. As shown in FIG. 7, the present embodiment has a waveform smoother 111 between the bandwidth expander 106 and the filter section 105 of FIG. 1.

Figures 8A, 8B, 8C, 8D, 8E, 8F, 8G:
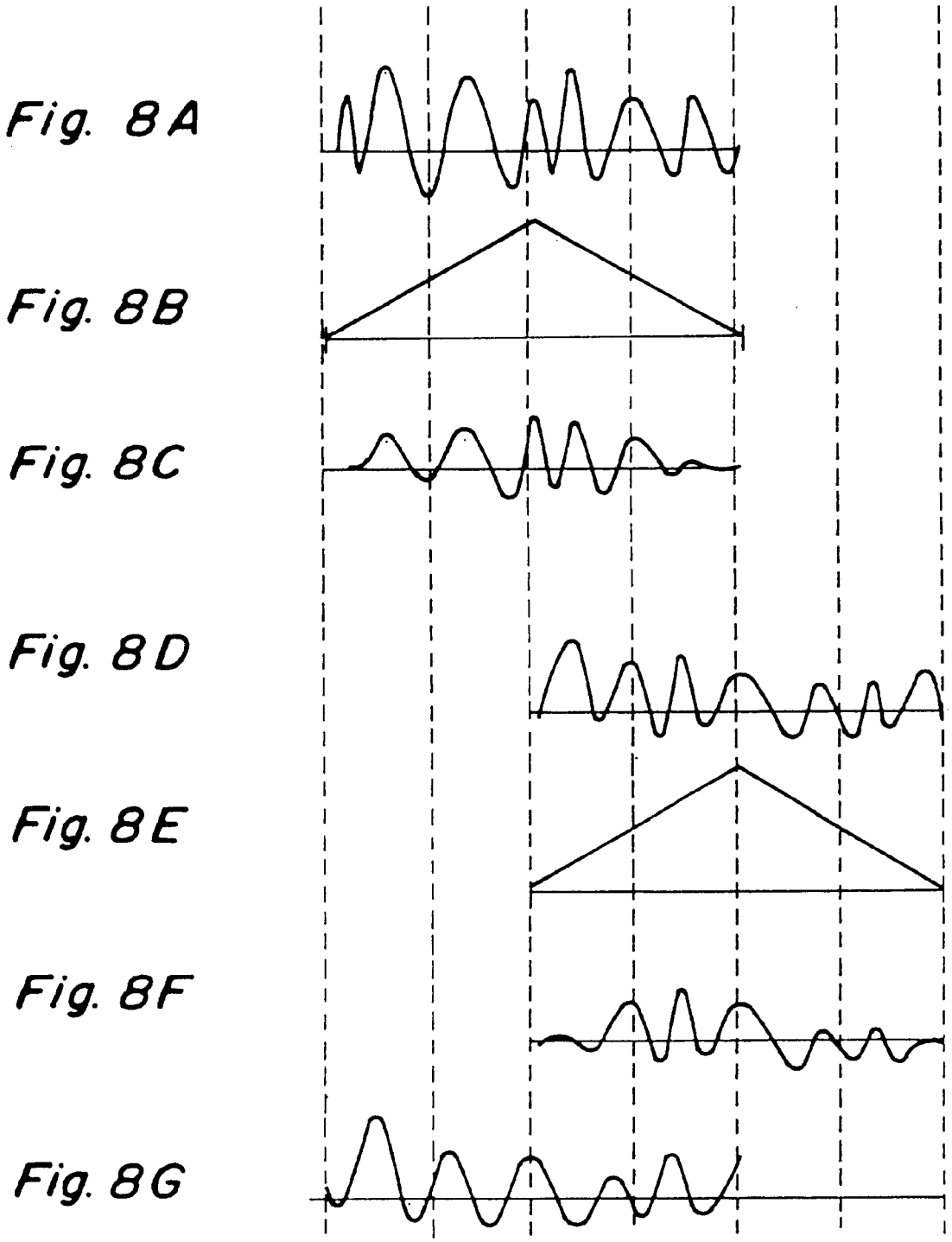
FIG. 8 is a schematic drawing illustrating the waveform smoother shown in FIG. 1.

The composition of the waveform smoother 111 is next described using the schematic illustration of FIG. 8. When the output signal of a bandwidth expander 106 is obtained for each determined time period (frame length), there exists discontinuity between the subsequent frames if the subsequent frame signals are simply connected to the filter 105 as they are. In the composition of the second embodiment, the discontinuity between the frame signals is mitigated by a waveform smoother 111. If the bandwidth expander 106 is constructed so as to temporarily overlap the subsequent frame signals, then the output frame signals are overlapped as shown in (a) and (d) of FIG. 8. The waveform smoother 111 multiplies the output signals of the bandwidth expander 106 by waveform smoothing functions to add them over the time domain, as shown in FIG. 8. Specifically, the output frame signals (a) and (d) of the bandwidth expander 106 are respectively multiplied by the smoothing function (b) and (e) of FIG. 8. The resulting signals (c) and (f) are then added over the time domain to output the signal (g). Let the output of the waveform smoother 111 and the output of the bandwidth expander 106 be respectively D(N, x) and F(N, x), where N is the frame number and x is the time within each frame. Let the waveform smoothing weight functions for the past frame and the present frame be respectively CFB and CFF, $$D(N,x)=CFB(x)\cdot F(N-1, x)+CFF(x)\cdot F(N, x). \tag{12}$$

Preferably, CFB and CFF are defined as $$CFB(x)=(-2\cdot x+L)/L, \tag{13}$$

$$CFF(x)=2\cdot x/L, \tag{14}$$

where L is the frame length.

Figure 11:
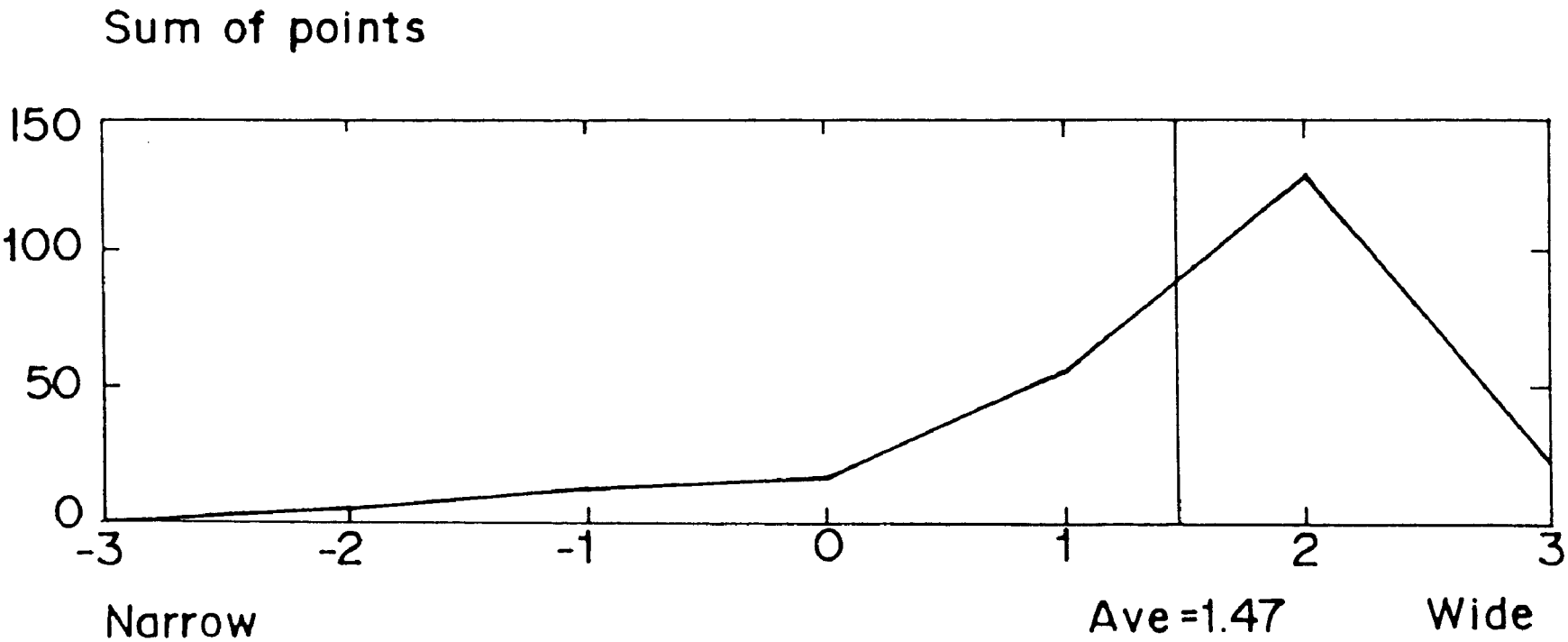
FIG. 11 illustrates the results of a subjective test for evaluating the present invention.

FIG. 11 illustrates results of a subjective test for evaluating the present invention. Test conditions are as follows;

(a) Content of test

Hearing test of an original speech of narrowband and corresponding speech of wideband recovered according to the present invention.

(b) Manner of evaluation

Seven steps evaluation of whether the synthesized speech has an expanded frequency range in comparison with the original speech of narrowband.

0 point: not distinguishable, 1 (−1) point: slightly distinguishable from the original speech (synthesized one), 2 (−2) point: distinguishable from the original speech (synthesized one), and 3 (−3) point: clearly distinguishable from the original speech (synthesized one)

(c) Number of tested persons 12 persons including researchers of phonetics.

(d) Number of linear mapping functions used 16 linear mapping functions having been obtained by learning 100 word speech samples.

(e) Sample data used for the test 10 sentences by a single speaker each having a length of about ten seconds.

(f) Used speaker monoral speaker

The test was done by making each person hear one set of original and synthesized speeches without noticing which is original one. Each person scored after hearing every one set.

The axis of abscissa in FIG. 11 denotes values of the seven steps evaluation and that of vertex denotes values of summation by 12 persons.

FIG. 11 indicates that the speech synthesized according to the present invention have a widely expanded sensation relative to an original narrowband speech.

It is to be noted that the A/D converter and the D/A converter are omittable in the case where the input speech signal is a digital speech signal for processing.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention.

What is claimed is:

1. An apparatus for recovering wideband speech from narrowband speech, said apparatus comprising:

a linear predictive coding analyzer for performing a linear predictive coding analysis on an inputted narrowband digital speech signal to thereby obtain a set of narrowband spectral envelope parameters and a residual signal;

a spectral envelope codebook having a plurality of spectral envelope codes, wherein each of the plurality of spectral envelope codes is a predefined set of narrowband spectral envelope parameters;

a linear mapping function codebook having a plurality of linear mapping functions for linearly mapping the set of narrowband envelope parameters to a set of wideband spectral envelope parameters which correspond to the plurality of spectral envelope codes on a one-to-one basis;

a selection means for selecting one linear mapping function from said linear mapping function codebook which provides a minimum distance to the set of narrowband spectral envelope parameters of the inputted narrowband speech signal;

a linear mapping function calculation means for calculating a set of wideband spectral envelope parameters using the selected one linear mapping function and the set of narrowband spectral envelope parameters directly obtained from said linear predictive coding analyzer;

a residual converter for converting the residual signal into a wideband residual signal; and a linear predictive coding synthesizer for synthesizing the set of wideband spectral envelope parameters calculated and the wideband residual signal so as to obtain a wideband digital speech signal.

2. An apparatus as claimed in claim 1, wherein the spectral envelope parameters obtained by said linear predictive coding analyzer are reflection coefficients.

3. An apparatus as claimed in claim 1, wherein the narrowband spectral envelope parameters obtained by said linear predictive coding analyzer are linear predictive codes.

4. An apparatus as claimed in claim 1, wherein the narrowband spectral envelope parameters obtained by said linear predictive coding analyzer are Cepstrum coefficients.

5. An apparatus as claimed in claim 1, further comprising:

a filter for extracting frequency components of the wideband digital speech signal which exist outside a bandwidth of the narowband digital speech signal; and a signal adder for adding a signal outputted from said filter to the inputted narrowband digital speech signal.

6. An apparatus as claimed in claim 5, further comprising:

a waveform smoothing circuit, arranged between said linear predictive coding synthesizer and said filter, for performing a waveform smoothing processing a n the wideband digital speech signal.

7. An apparatus as claimed in claim 5, wherein said filter is a FIR filter.

8. An apparatus as claimed in claim 5, wherein said filter is an IIR filter.

9. An apparatus for recovering wideband speech from narrowband speech, said apparatus comprising:

a linear predictive coding analyzer for performing a linear predictive coding analysis on an inputted narrowband digital speech signal to thereby obtain a set of narrowband spectral envelope parameters and a residual signal;

a spectral envelope codebook having a plurality of spectral envelope codes, wherein each of the plurality of spectral envelope codes is a predefined set of narrowband spectral envelope parameters;

a linear mapping function codebook having a plurality of linear mapping functions for linearly mapping the set of narrowband envelope parameters to a set of wideband spectral envelope parameters which correspond to the plurality of spectral envelope codes on a one-to-one basis;

a distance calculation means for calculating a distance between the set of narrowband spectral envelope parameters and each of the plurality of spectral envelope codes contained in said spectral envelope codebook;

a weights calculations means for calculating weights for the spectral parameters based on, and corresponding to, each of the distances calculated by said distance calculations means;

a linear mapping function calculation means for calculating a plurality of sets of wideband spectral envelope parameters using each of the plurality of linear mapping functions contained in said linear mapping codebook and the set of narrowband spectral envelope parameters directly obtained from said linear predictive coding analyzer;

a linear map result adder for weighing the plurality of sets of wideband spectral envelope parameters using the weights calculated by said weights calculation means and for summing the weighted sets of transformed spectral envelope parameters to obtain a set of wideband spectral envelope parameters;

a residual converter for converting the residual signal into a wideband residual signal; and a linear predictive coding synthesizer for synthesizing the set of wideband spectral envelope parameters and the wideband residual signal so as to obtain a wideband digital speech signal.

* * * * *